US005893259A

United States Patent [19]

Posge

[11] Patent Number: 5,893,259

[45] Date of Patent: *Apr. 13, 1999

[54] METHOD OF OPERATING A PRODUCT FILLER HEAD SYSTEM

[75] Inventor: Joe F. Posge, Cincinnati, Ohio

[73] Assignee: Planet Products Corporation, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/651,831

[22] Filed: May 21, 1996

Related U.S. Application Data

[62] Division of application No. 08/532,221, Sep. 21, 1995.

[51] Int. Cl.[6] ..... B65B 35/30

[52] U.S. Cl. ..... 53/448; 53/55; 53/495; 53/444; 53/247; 53/542

[58] Field of Search ..... 53/448, 473, 55, 53/495, 444, 148, 247, 201, 542, 543; 198/419.2, 419.3

[56] References Cited

U.S. PATENT DOCUMENTS

| | | | |
|---|---|---|---|
| 4,722,168 | 2/1988 | Heaney | 53/450 |
| 4,882,895 | 11/1989 | Hsieh et al. | 53/531 |
| 4,924,657 | 5/1990 | Berti et al. | 53/450 |
| 4,972,655 | 11/1990 | Ogawa | 53/155 |
| 5,177,930 | 1/1993 | Harston et al. | 53/55 |
| 5,335,482 | 8/1994 | Kinigakis et al. | 53/448 |
| 5,339,606 | 8/1994 | Benz | 53/444 |
| 5,388,385 | 2/1995 | Phelps et al. | 53/247 |

FOREIGN PATENT DOCUMENTS

| | | |
|---|---|---|
| 2938095 | 4/1981 | Germany . |
| 2180131 | 7/1990 | Japan . |
| 2183366 | 6/1987 | United Kingdom . |

*Primary Examiner*—Jessica J. Harrison
*Assistant Examiner*—John Paradiso
*Attorney, Agent, or Firm*—Thompson Hine & Flory LLP

[57] ABSTRACT

A product filler head system having an input conveyor with a first drive motor for delivering product items, an index pusher for receiving the product items from the input conveyor, accumulating the product items into groups of a selected size and releasing the groups onto a staging area, the index pusher including a second drive motor, an index lug chain for receiving selected numbers of the groups of product items from the index pusher and displacing the selected number of groups of product along the staging area, the index lug chain including a third drive motor, a ram for displacing the groups of product items from the staging area into a receptacle, the ram including a fourth drive motor, and a selectively programmable computer control for individually actuating the first, second, third and fourth motors such that speeds of the conveyor, index pusher and lug chain are synchronized with respect to each other and with sequencing of the ram, so that changes in the size of the groups of product items and changes in arrangement of the array of groups of product items are compensated for by selective programming of the computer control to vary relative speeds and sequencing of the first, second, third and fourth motors. Consequently, in order to vary the size and arrangement of groups onto the staging area, the index lug chain is replaced with an index lug chain having lugs of the desired spacing, and the computer control is programmed to correspondingly adjust the speeds and sequencing of the input conveyor, index pusher, index lug chain and ram to coordinate these components with respect to each other, thereby eliminating the need for mechanical interconnection between these components and the replacement of mechanical components such as sprockets and the like to vary the relative speed and timing of the components.

11 Claims, 11 Drawing Sheets

METHOD OF OPERATING A PRODUCT FILLER HEAD SYSTEM

This is a divisional of application Ser. No. 08/532,221, filed Sep. 21, 1995.

BACKGROUND

The present invention relates to product handling systems and, more particularly, to product handling systems for receiving product items, accumulating the product items into groups and transferring the grouped product items to a receptacle.

Packing machines for food articles of uniform size and shape are typical of product item handling systems, and include components for delivering product items individually, accumulating the product items into groups of a selected number of items, arranging the groups of items in an array of groups on a staging area and transferring the array of groups of items from the staging area to a receptacle.

Typically, the receptacle comprises a plurality of recesses which correspond in size and arrangement to the array of groups of product items on the staging area.

An example of such a product handling system is a food article filling head of the type disclosed in Phelps et al. U.S. Pat. No. 5,388,385. That patent discloses a food article filling head having an input conveyor for delivering individual food items, an index pusher for receiving the food items from the input conveyor and accumulating the items into groups, a staging area for receiving an array of groups of food items, and a ram assembly for displacing the array of groups of food items downwardly through trap doors in the staging area into a receptacle. The filling head includes an assembly of sprockets and sprocket chains which interconnect the input conveyor, index pusher, and a flywheel which is part of the ram assembly. All of these components are driven by a single power source, which requires that the sizes of the sprockets in the assembly be adjusted to provide the necessary synchronization of operation between the components.

The invention also includes a computer control which senses the position of the index pusher and, at the appropriate period in the cycle of the index pusher, energizes a clutch in the sprocket linkage to actuate the ram assembly.

A disadvantage with such systems is that, in order to adjust such systems to operate differently, such as varying the number of items per group of accumulated food items, or varying the size or number of groups in an array on the staging area, it is necessary to perform a laborious operation of sprocket replacement in order to change the sprocket tooth ratios among the components to vary the speed and sequencing of the components. Such a process requires considerable system downtime, and further is expensive to implement since it requires a number of closely-toleranced sprocket components. Accordingly, there is a need for a product filler head system which minimizes downtime and is capable of making rapid adjustments in the relative speeds and sequencing of the components.

SUMMARY OF THE INVENTION

The present invention is a product filler head system with a computer control in which the speed and sequencing of the input conveyor, product accumulator, index lug chain and ram assembly are individually powered by servomotors whose action is coordinated by a computer control.

Accordingly, the operation of the overall system to vary the number of product items accumulated into a grouping, and further, to vary the numbers of groups of accumulated items on a staging area for loading into a receptacle, can be varied simply by varying the speeds of the servomotors driving the components and replacing the index lug chain.

The advantage of the system of the present invention is that it eliminates the expensive and closely toleranced sprocket linkage which interconnected such components of prior art systems and further, eliminates the need to vary the relative speeds of the components by adjusting or replacing the mechanical linkages which drive those components, thereby minimizing the system downtime required to effect a change of operation.

In a preferred embodiment of the invention, the product filler head includes an input conveyor for delivering individual product items powered by a first servomotor, an index pusher powered by a second servomotor for receiving product items from the input conveyor and accumulating the product items into a group, a staging area including an index lug chain powered by a third servomotor for receiving groups of accumulated product items from the index pusher and arranging the product items in an array of groups on the staging area, and a ram assembly powered by a fourth servomotor for displacing the array of groups of product items from the staging area to a receptacle. A computer control includes sensors which read the positions of the input conveyor, index pusher, index lug chain and ram assembly, and actuate the servomotors to initialize the position of the components, then operate the components at the speeds and sequencing required to collect, arrange and load the product items into a receptacle.

In order to effect a change of operation of the filler head of the present invention, such as changing the number of product items per group or changing the number of groups of product items in an array on the staging area, all that is required is to replace the index lug chain with an index lug chain whose lugs have the appropriate spacing; the computer control is programmed to adjust the speeds and sequence of operation of the servomotors accordingly. Further, the computer control can be modified to perform any "fine tuning" of the speeds and sequencing of the components as required.

Although the preferred embodiment is described with respect to using a fifth motor, that being an AC motor, which controls a stuffer shaft for aligning the product items as they are delivered from the input conveyor to the index pusher, it is within the scope of the invention to provide filler head systems with one, two, three or four servomotors, depending upon the particular application envisioned, and the degree of flexibility desired by the operator. For example, in a single controlled axis system with a single computer controlled servomotor, the ram assembly alone would be controlled by the computer, and the other components would be controlled by an interconnected sprocket and chain assembly. Consequently, the computer controlled motor would replace the clutch of prior art systems. In a two controlled axis system, the computer would control servomotors of the input conveyor and the index pusher. This would allow an operator to set counts on the system electronically instead of making mechanical adjustments.

In a three axis system, the computer would control servomotors of the input conveyor and index pusher, as well as a servomotor for the ram assembly. Alternatively, the third servomotor would control the index lug chain. A four axis system would include computer controlled servomotors for the input conveyor, index pusher, index lug chain, and AC motor on the stuffer shaft, or alternately consist of computer controlled servomotors for the input conveyor, index pusher, ram assembly and AC motor on the stuffer shaft.

Accordingly, it is an object of the present invention to provide a product filler head system in which the various components of the system are individually computer controlled to provide cooperation in speed and sequencing of operation; a filler head system in which adjustments with respect to the capacity and operation of the system are effected with a minimum of mechanical adjustment and component substitution; a filler head system which minimizes the amount of mechanical interconnection between the components, thereby minimizing the need for closely toleranced sprocket chain systems and the like; and a filler head system which is inexpensive to maintain and relatively simple to retrofit into existing systems and adjust.

Other objects and advantages will be apparent from the following description, the accompanying drawings and the appended claims.

DETAILED DESCRIPTION

Figure 1:
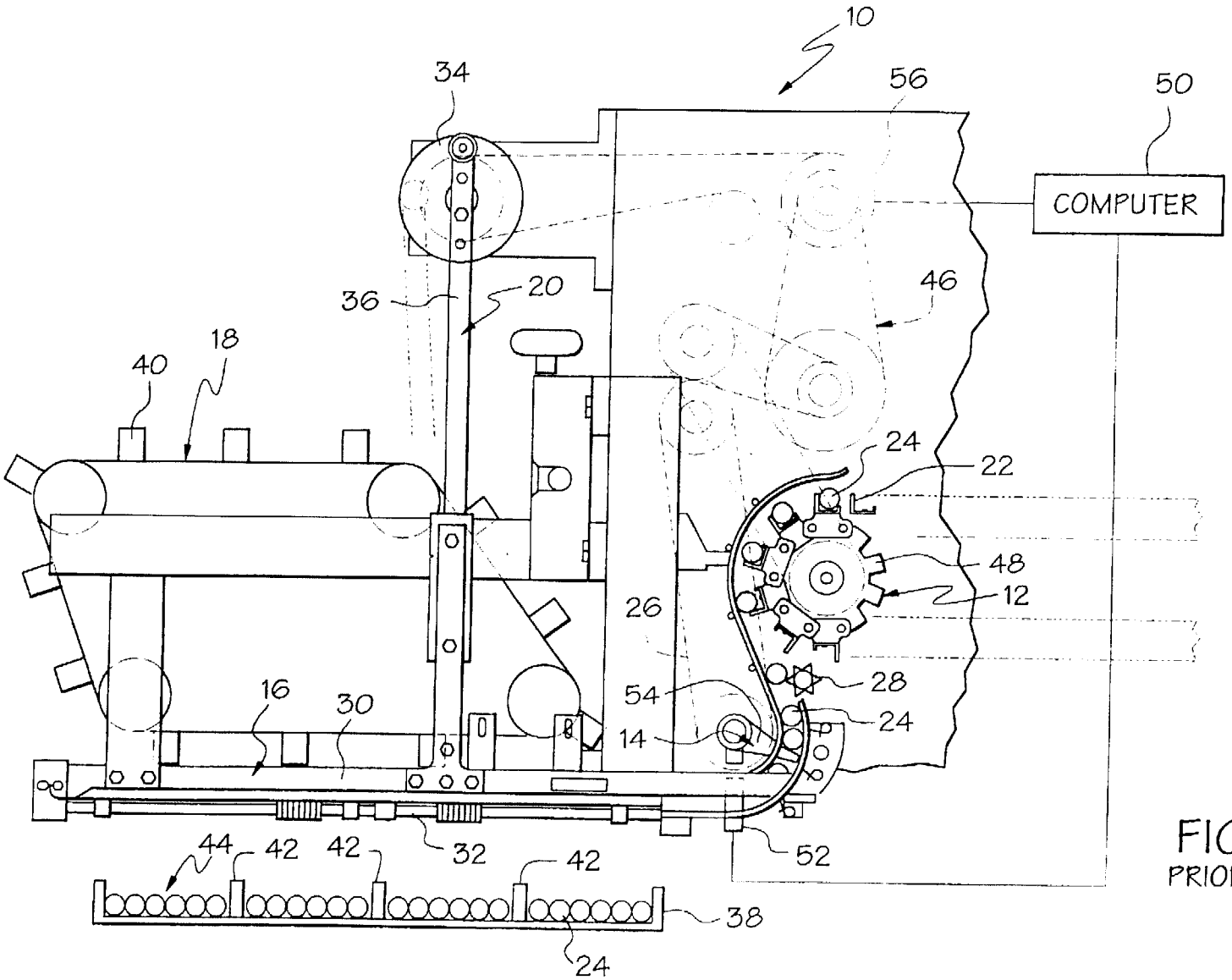
FIG. 1 PRIOR ART
FIG. 1 is a schematic, side elevation of a filler head system of the prior art.

As shown in FIG. 1, a prior art product filler head, generally designated 10, includes a product input conveyor 12, index pusher 14, staging area 16, index lug chain assembly 18 and ram assembly 20. The input conveyor 12 is a chain conveyor which includes a plurality of L-shaped buckets 22, each of which receives an individual product item 24, such as a cooked frankfurter. The product items 24 are discharged from the input conveyor 12 along an S-cage 26 to the index pusher 14, which acts as an accumulator to receive a predetermined number of product items 24, which queue up in the S-cage. A sprocket stuffer shaft 28 is positioned between the input conveyor 12 and the index pusher 14 to receive and align the individual product items 24 as they are deposited by the conveyor in the S-cage 26. The staging component 16 includes a support frame 30 having a series of spring-loaded doors 32 (only one of which is shown) comprising its bottom surface.

The ram assembly 20 includes a flywheel 34 which drives a link arm 36 connected to a plate (not shown) positioned above the frame 30. When the flywheel 34 is cycled through a 360° motion, the link arm 36 is reciprocated downwardly and upwardly to displace product items on the staging area 16 downwardly through the spring-loaded doors 32 and into a receptacle 38.

The index lug chain 18 includes a plurality of lugs 40 which are shaped and spaced to correspond to the dividers 42 of the receptacle. Accordingly, actuation of the index lug chain 18 such that the chain rotates in a clockwise direction shown in FIG. 1, causes the lug chain to receive groupings of collected product items 24 and displace the groupings along the staging area. The ram assembly 20 is cycled to displace the array of collective product items downwardly through the spring-loaded doors 32 and into the recesses 44 of the receptacle 48.

A series of sprocket wheels and sprocket chains, generally designated 46, interconnects the flywheel 34, sprocket 48 of input conveyor 12, index pusher 14, and index lug chain 18 to synchronize the movement of these components. A computer control 50 includes a sensor 52 for detecting a position of the sweep arm 54 of the index pusher and actuates a clutch 56, which comprises a portion of the sprocket chain system 46 to cycle to the flywheel 34, and link arm 36 of the ram assembly 20.

Accordingly, in order to adjust the relative speed of the components 12, 14, 18, 20, it is necessary to substitute sprocket wheels of the sprocket system 46. Such adjustment is necessary when a different grouping of product items, or a different array of groups of product items is desired on the staging area. The foregoing structure is described in greater detail in commonly owned U.S. Pat. No. 5,388,385, the disclosure of which is incorporated herein by reference.

Figure 2:
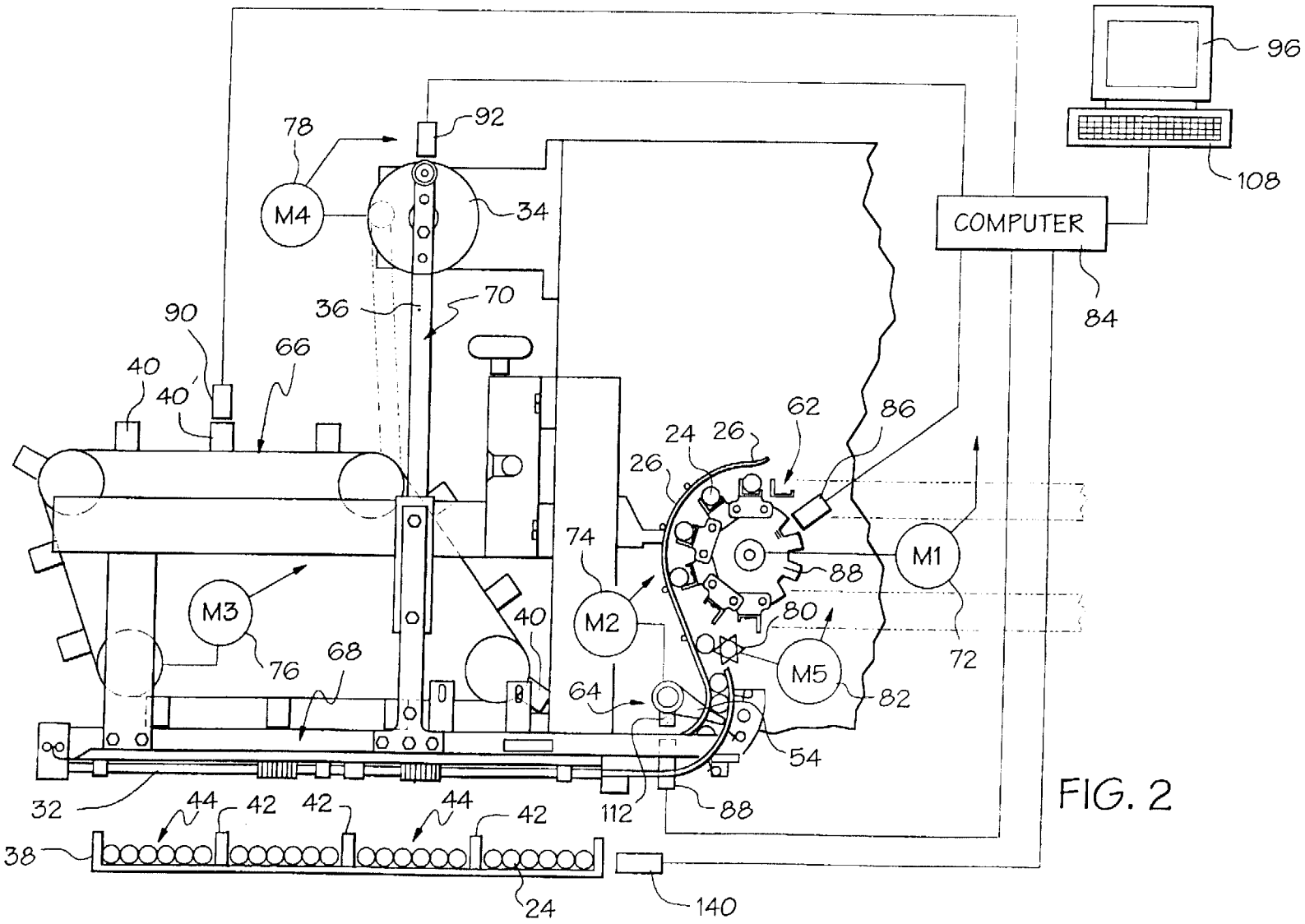
FIG. 2 is a schematic, side elevation of a preferred embodiment of a filler head system of the present invention.

As shown in FIG. 2, the product filler head system of the present invention, generally designated 60, includes an input conveyor 62, an index pusher 64, an index lug chain 66, a staging area 68, and a ram assembly 70. The input conveyor 62 includes servomotor 72, the index pusher 64 includes servomotor 74, the index lug chain 66 includes servomotor 76, and the ram assembly 70 includes servomotor 78. The stuffer shaft 80 also includes a separate drive motor 82, which preferably is an AC motor. Motors 72–78, 82 are all actuated by a computer control 84. As can be seen by comparing the structures of FIG. 1 and FIG. 2, the mechanical interconnection comprising the sprocket and sprocket chain assembly 46 is no longer required, since each individual component of the filler head system 60 is powered independently by one of the motors 72–78, 82. The computer control 84 also includes a sensor such as proximity switch 86 to detect a position of the sprocket wheel 88 of the input conveyor 62, a sensor such as proximity switch 89 to detect the position of the sweep arm 54 of the index pusher 64, a sensor such as proximity switch switch 90 to detect the initial position of the index lug chain 66, and a sensor such as proximity switch 92 to detect the home position of the flywheel 34 of the ram assembly 70.

In operation, the computer control 84 first initializes the system by actuating the motors 72–78 to rotate their respective components to home positions. Once the initialization process has been completed, the motors 72–78, 82 are actuated by the computer control 84 such that the input conveyor 62 delivers product items 24 to the S-cage 26 where they are received and accumulated by the index pusher 64 into groups of a predetermined size, such as five product items, for example.

Actuation of motor 74 causes the sweep arm 54 of the index pusher 64 to rotate, thereby releasing the collected product items 24, allowing them to fall downwardly through the S-cage and onto the staging area 68. There, they encounter a lug 40 of the index lug chain which displaces the group of collected product items sidewardly from right to left in FIG. 2. Successive lugs 40 of the index lug chain 66 move collected groups of product items 24 across the staging area 68 until they form an array which corresponds in group size and arrangement, and are superposed to the arrangement of product items 24 in the recesses 44 of the receptacle 38. At that time, the computer control 84 actuates motor 78 to cycle the ram assembly 70, thereby displacing the array of groups of product items 24 downwardly through the spring-loaded doors 32 and into the receptacle 38.

Figure 3:
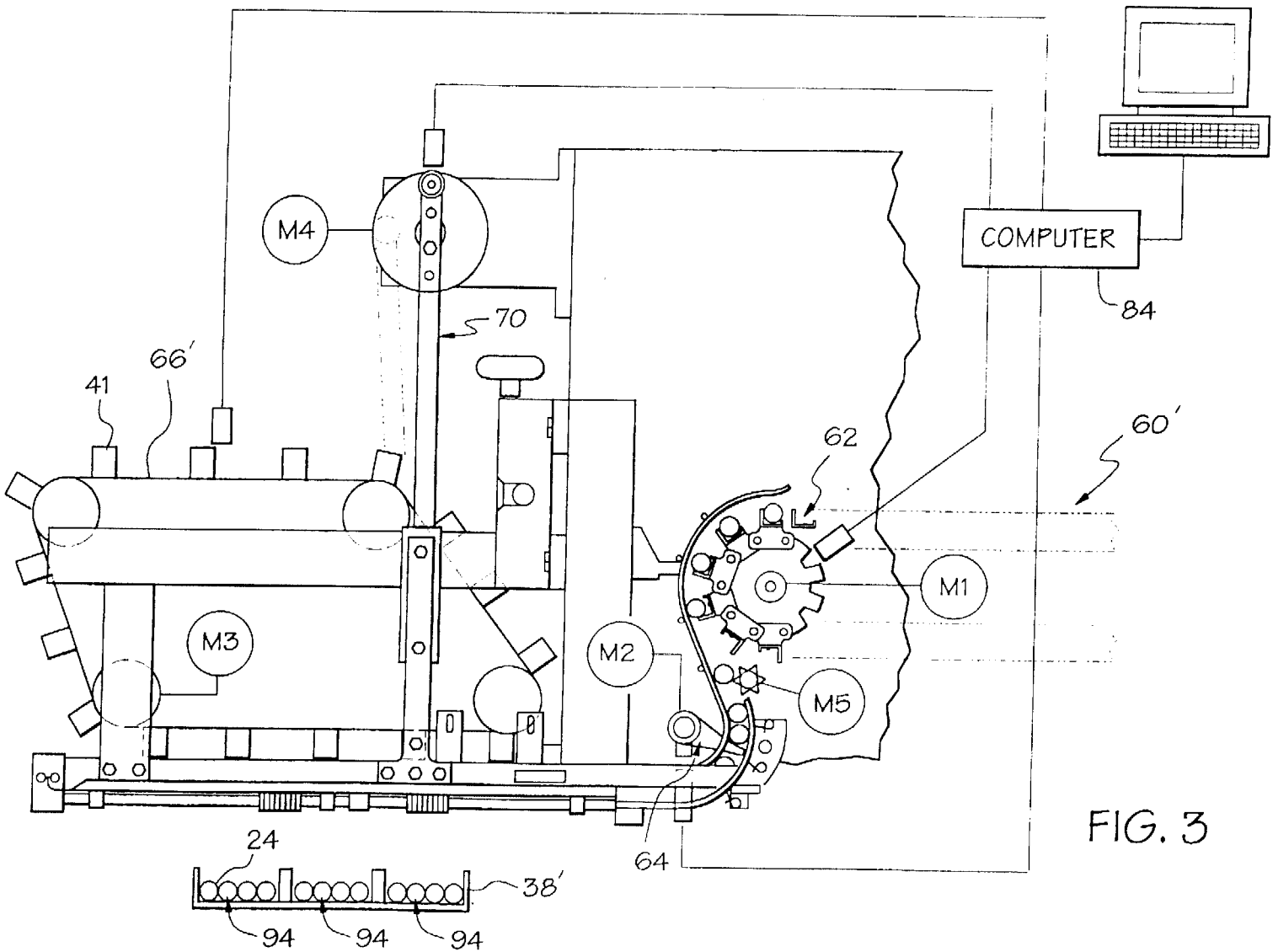
FIG. 3 is a schematic, side elevation of the filler head system of the present invention with a different index lug chain substituted with respect to the embodiment disclosed in FIG. 2.

As shown in FIG. 3, a filler head 60' is shown in which the index lug chain 66' has been substituted for chain 66. Chain 66' includes lugs 41 which are spaced closer together than the lugs 40 of the chain 66 of FIG. 2. This would be necessary for filling a receptacle 38' for receiving groups of four product items 24.

In order to adjust the system 60 to the configuration 60' shown in FIG. 3, all that is required is to replace the index lug chain 66 with lug chain 66'. The speed and sequencing of the input conveyor 62, index pusher 64, index lug chain 66' and ram assembly 70 are all adjusted accordingly by the computer control.

As shown in FIGS. 4A–4H, the operation of the computer control 84 is as follows. Once the computer control 84 is powered up, the screen 96 (see FIG. 2) of the computer displays a menu as shown at 98 in FIG. 4A. Initially, the operator elects PROGRAM SELECT at 100, a process shown in FIG. 4H.

In the PROGRAM SELECT MODE, the operator enters a number at 102 corresponding to a desired operational program. This causes the computer to load into memory operating parameters such as the number of items 24 per group 94 (see FIG. 3), the number of layers of groups of product per receptacle 44 (see FIG. 2), the high and low speeds of operation of the system 60, and the relative speeds of other components associated with the system 60. The operator then has an opportunity, if desired, to check or change program data at 104. After this is accomplished, the computer returns to the main menu, shown in FIG. 4A.

Figure 4A:
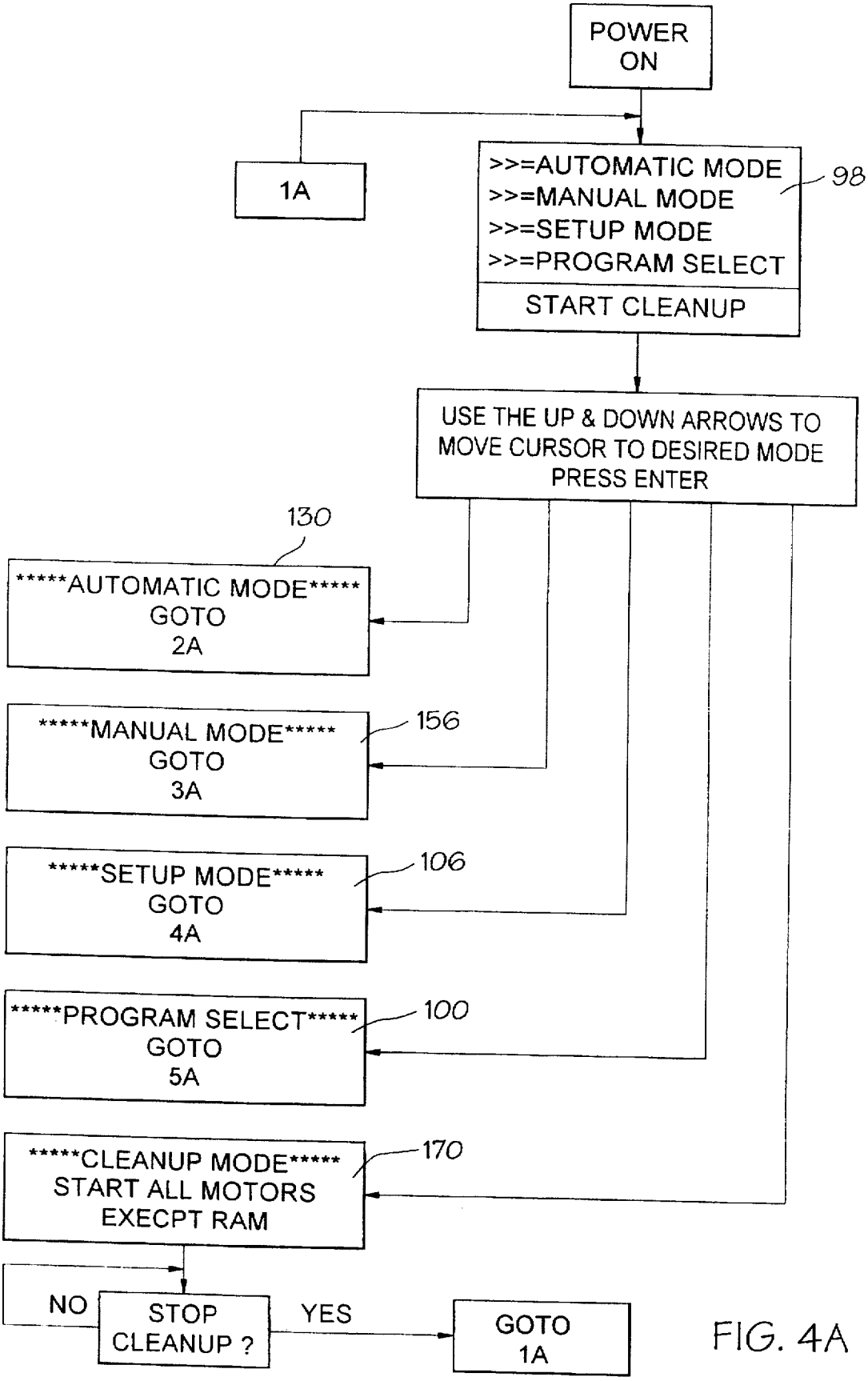
FIGS. 4A, 4B, 4C, 4D, 4E, 4F, 4G and 4H show a flow chart representing the operation of the computer control of a preferred embodiment of the present invention.
Figure 4B:
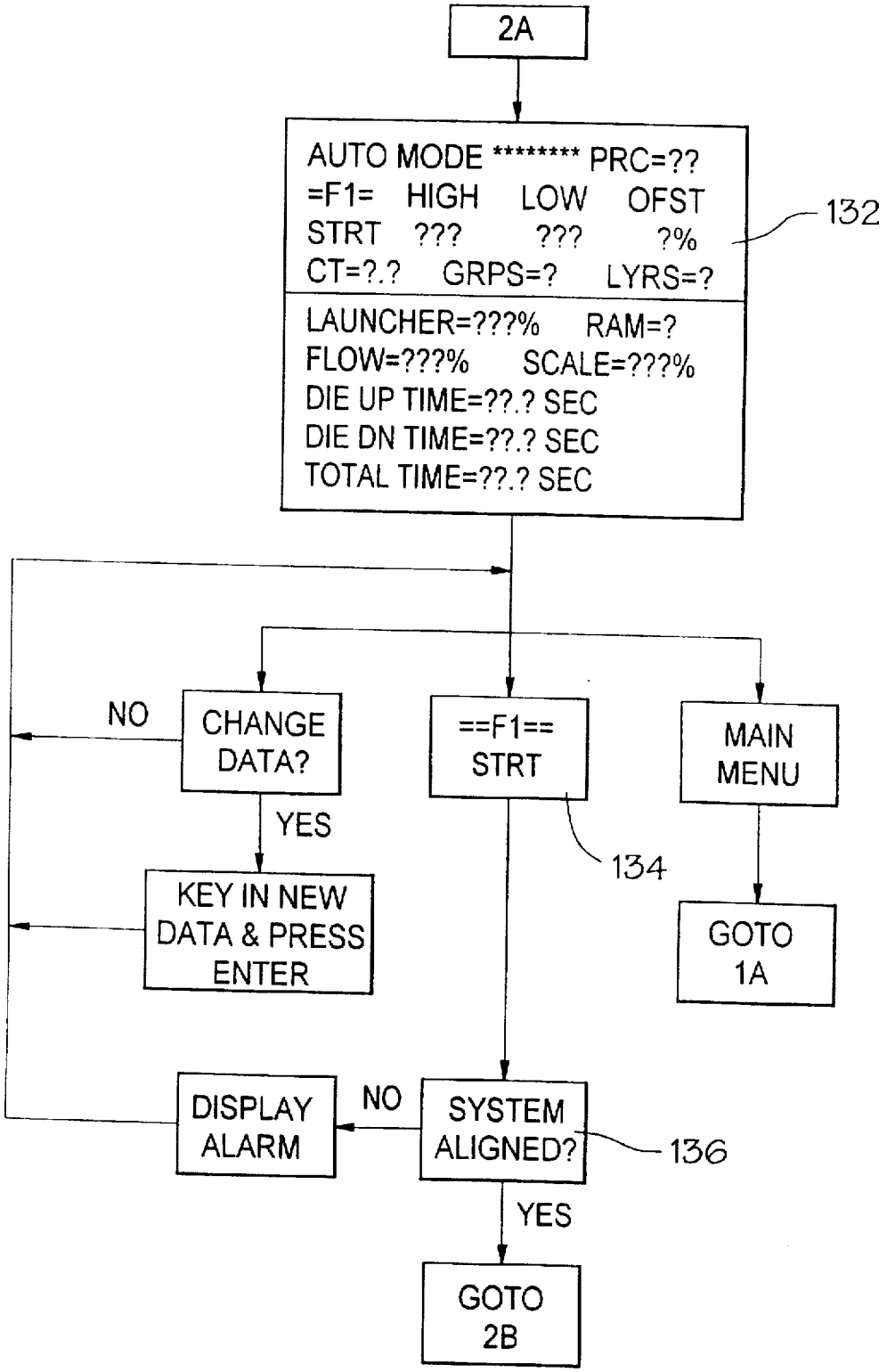
Figure 4C:
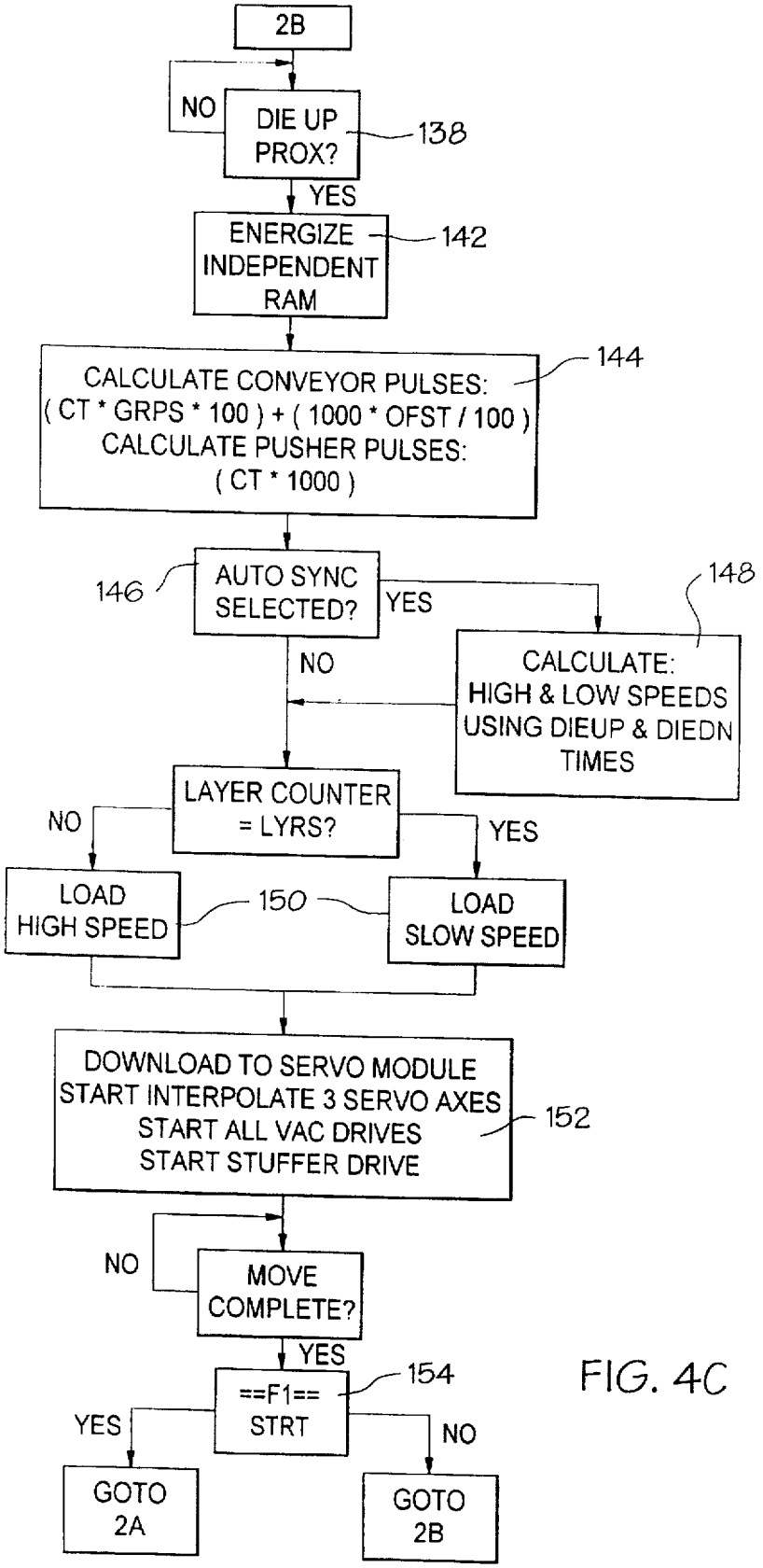
Figure 4D:
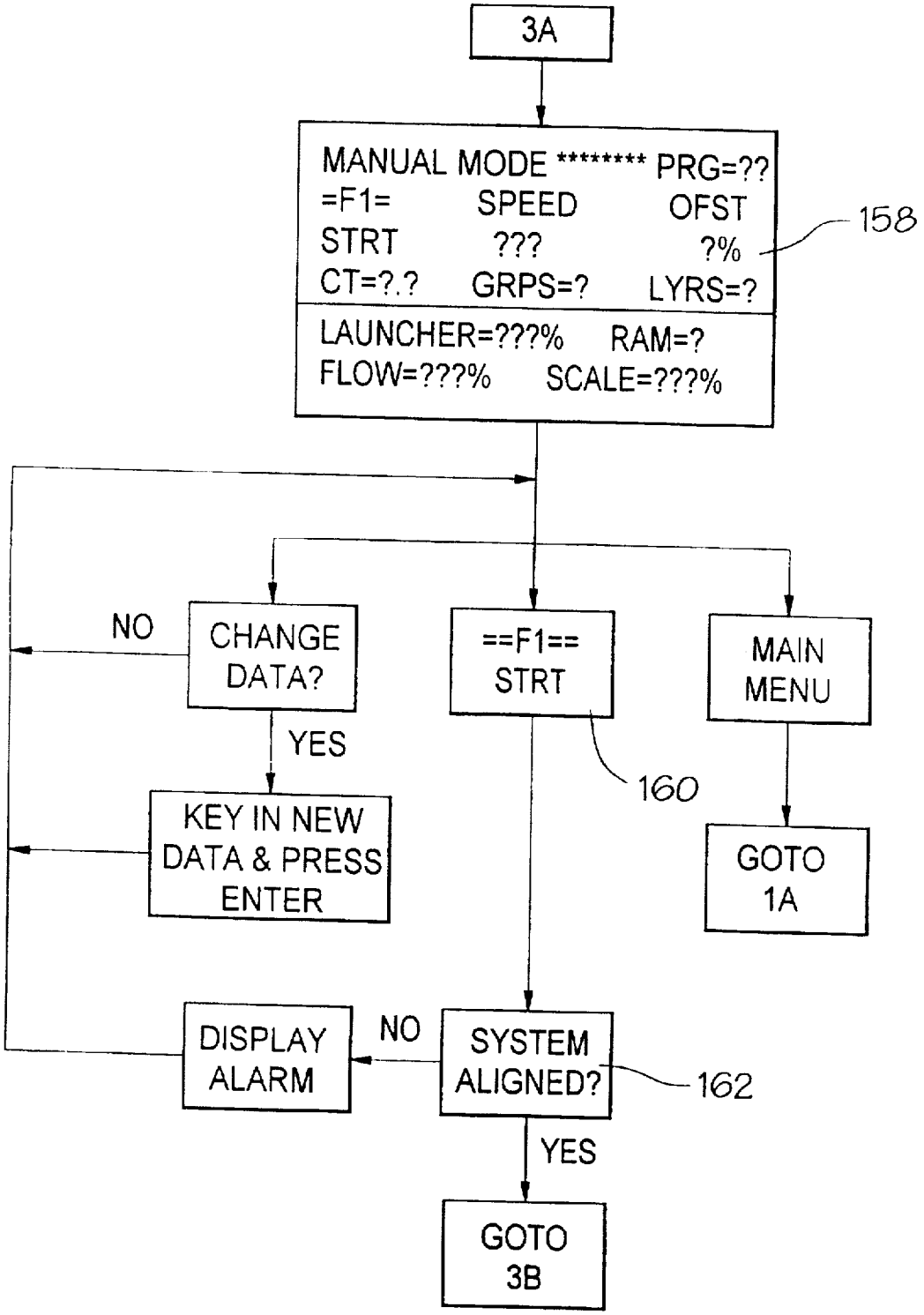
Figure 4E:
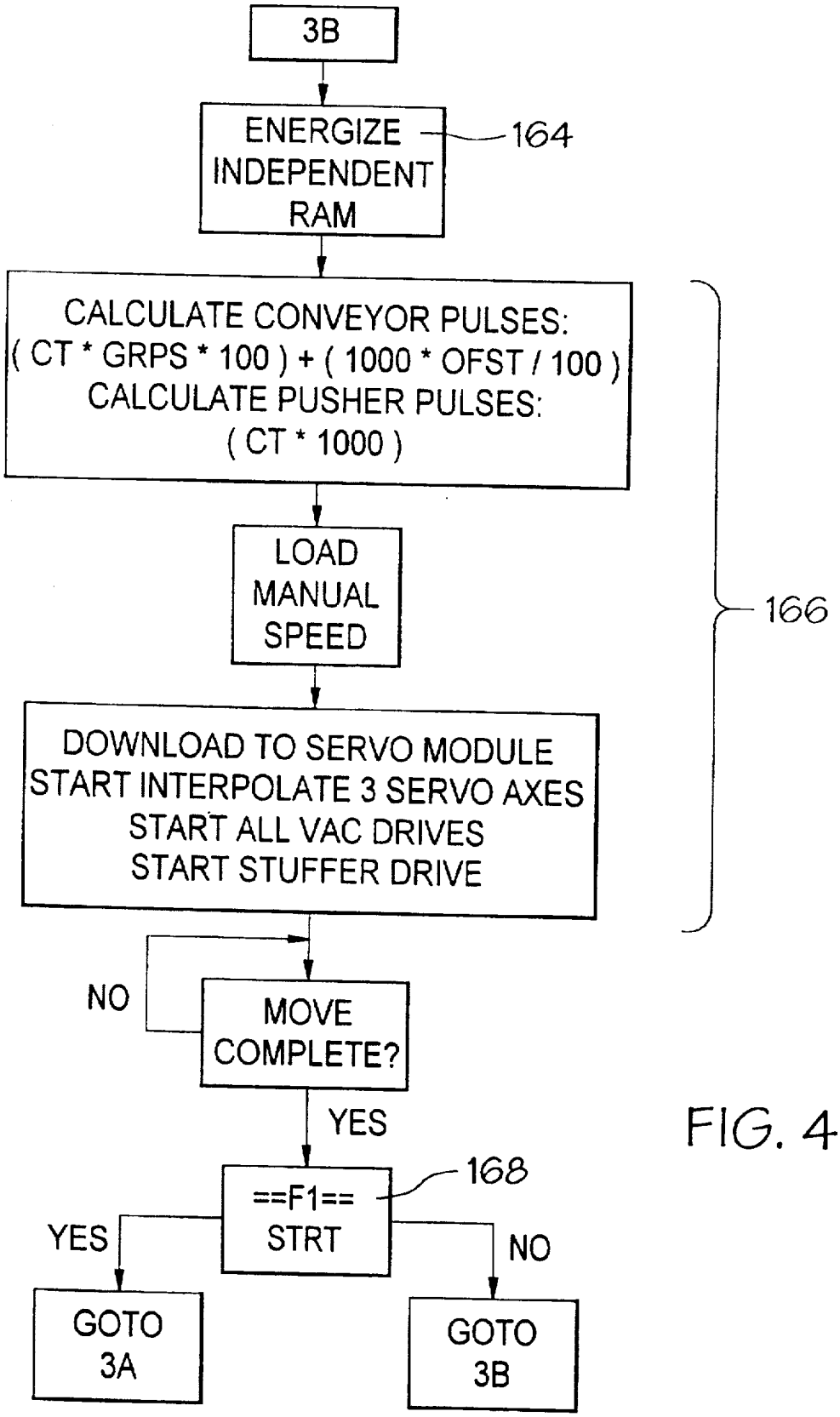
Figure 4F:
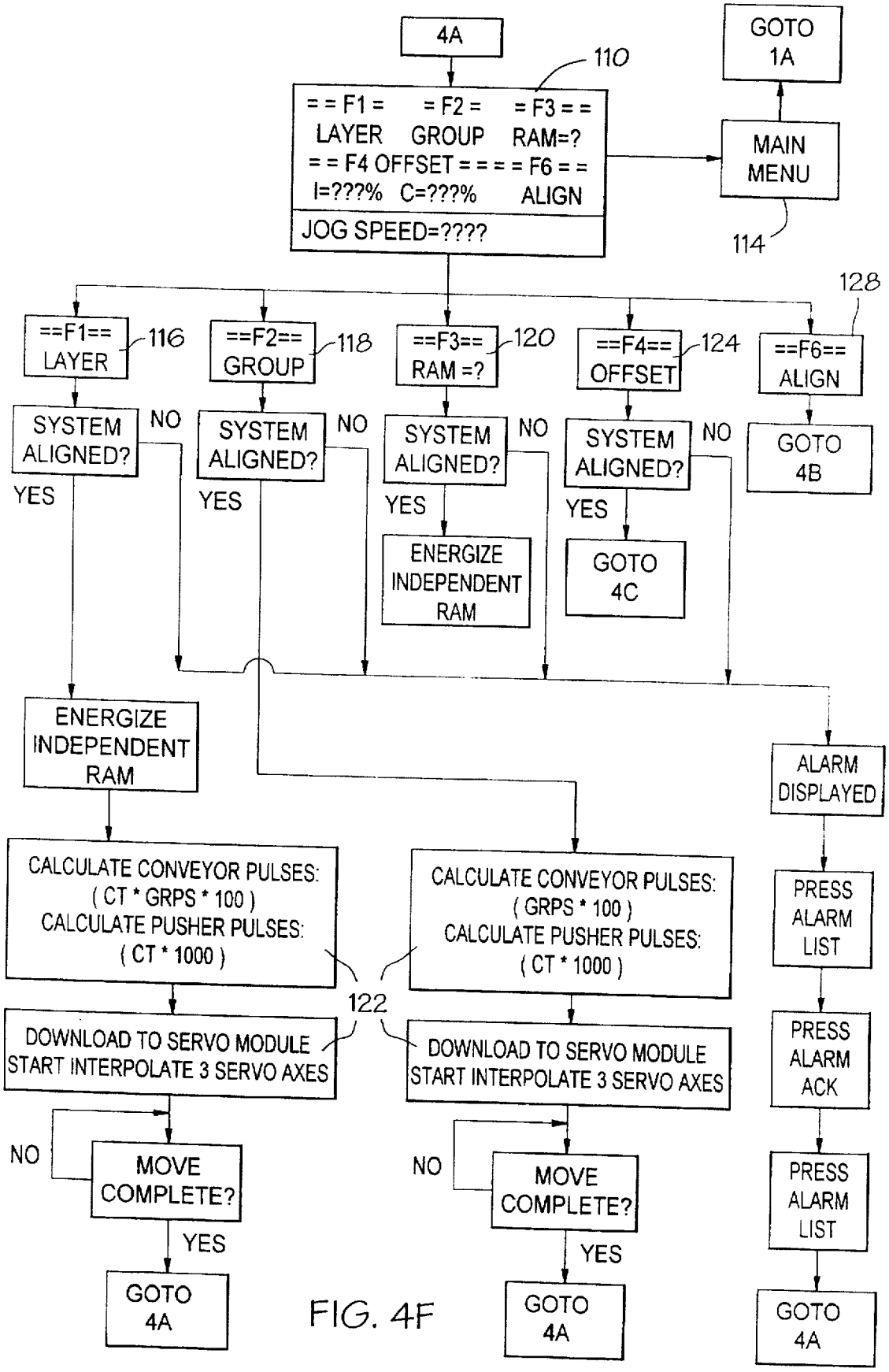
Figure 4G:
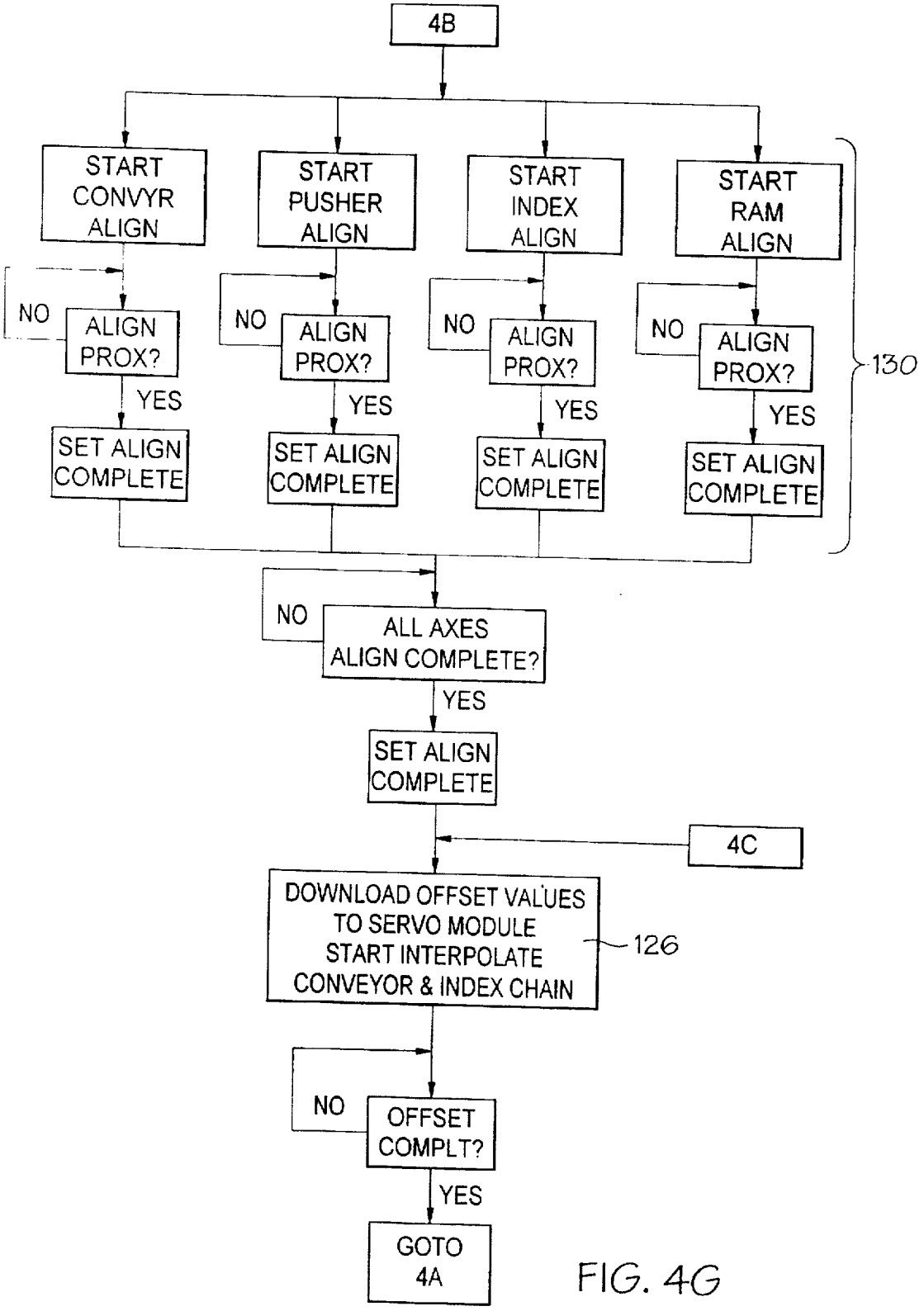
Figure 4H:
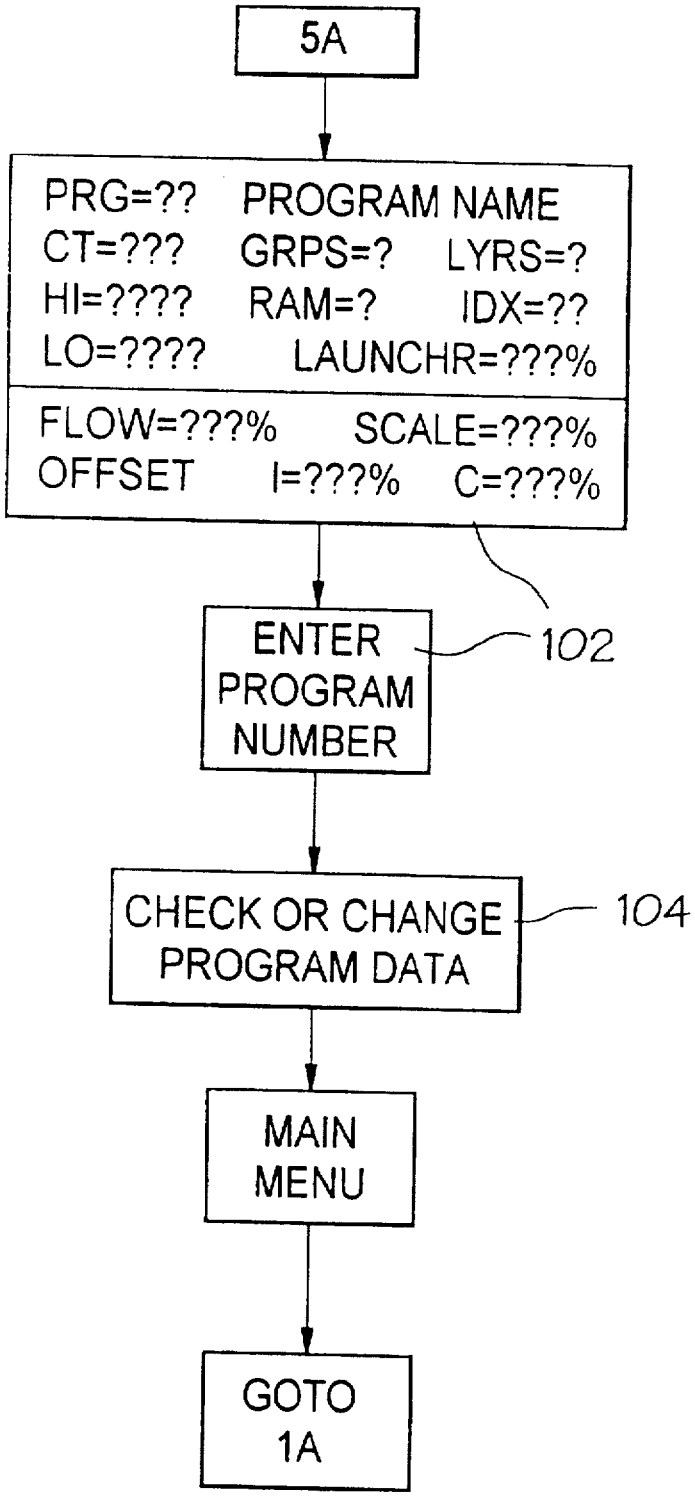

At this time, the operator elects to run the SETUP MODE at 106, which is shown in FIGS. 4F and 4G. SETUP MODE is used to run a sample number of product items through the system 60 in order to check settings of the various components, such as the input conveyor 62, index pusher 64 and index lug conveyor 66 (See FIG. 2). The operator presses the F6 key on a keypad 108 (see FIG. 2) associated with the computer 84, as indicated at 110 in FIG. 4F, and the computer automatically aligns the system 60. This alignment occurs by the computer 84 actuating motor 74 to rotate the index pusher sweep arm 54 such that a lug 112 aligns with proximity switch 89. Similarly, motor 76 of the index lug chain 66 is actuated to bring marked lug 40' into alignment with proximity switch 90. Motor 78 of the ram assembly 70 is actuated to rotate the flywheel 34 to bring the top of the crank arm 36 into alignment with the proximity switch 92. Similarly, the sprocket 88 of input conveyor 62 is rotated to bring a marked portion of that sprocket into alignment with proximity switch 86.

At this time, the operator can elect to run the system by returning to the main menu, shown at 114. Alternately, the operator can depress one of the function keys, F1, F2 or F3, shown at 116, 118, 120, of keypad 108 (see FIG. 2) to cycle either the entire system to deposit a layer of product groups on the receptacle 38, or to generate a group of product items 24. As shown at 122, this is achieved by the computer 84 generating pulses to the respective servomotors 72, 74, 76 to rotate a predetermined amount. Once this is complete, the computer 84 takes the operator back to the menu shown at 110.

If the F3 key is depressed at 120, the ram assembly 70 is cycled. If the F4 key is depressed at 124, the input conveyor 62 and the index lug conveyor 66 can be offset relative to the other components as needed to perform fine tuning adjustments of the system, as shown at 126 in FIG. 4G. Once this process is completed, the computer takes the operator back to the menu at 110.

If the F6 key is depressed, there is actuated by the operator at 128, the alignment procedure mentioned earlier is performed, as shown in detail in FIG. 4G at 130.

Once the alignment and set-up procedure is completed, the computer 84 returns the operator to the set-up menu at 110 in FIG. 4F. Typically, the operator would press the main menu key at 114 to go to main menu at 98 in FIG. 4A. At this point, the operator would typically enter the AUTOMATIC MODE shown at 132, and which is set forth in FIGS. 4B and 4C. As shown at 132, in the AUTOMATIC MODE the computer 82 loads various stored parameters into memory and, upon actuation of the F1 start key at 134, the operation of the system 60 begins. Initially, as shown at 136, the computer 84 checks to determine whether or not the alignment procedure, which is part of the setup mode at 106 in FIG. 4A, has been run. If so, the system operation 60 is allowed to proceed, as shown in FIG. 4C. First, the computer determines whether a die or receptacle 38 is present, shown at 138, which is detected by proximity switch 140 shown in FIG. 2.

As shown at 142, the ram assembly motor 78 is energized, to cycle the ram assembly 70. Typically at this time there are groups of product items 24 on the staging area 68 (see FIG. 2). As shown at 144 in FIG. 4C, the computer 84 sends a predetermined number of pulses to servomotors 72, 74, 76 to actuate the input conveyor 62, index pusher 64, and index lug chain 66. The index stuffer motor 82 is also energized at this time. As shown at 146, if the operator elects "AUTO SYNC," the computer 84 automatically varies the operational speed of the components of the system to coordinate with the packaging machinery, which controls the replacement of a full receptacle 38 by an empty receptacle, shown at 148, 150. As shown at 152, the process continues with all servomotors 72–76 and Vac Motor 82 in operation, running in a synchronized, coordinated speed, until the operator stops the operation by depressing the F1 key, shown at 154. At that time, the computer stops the system. The operator can return to the main menu 98 by pressing the main menu key.

As shown in FIG. 4A, the operator can elect to go into MANUAL MODE at 156, shown in FIGS. 4D and 4E. The manual mode is similar to the automatic mode, shown in FIGS. 4B and 4C, except that it is designed to operate the system 60 without monitoring the receptacles 38. This typically is desired when the system 60 is first set up, or if alterations have been made, such as substitution of a different index lug chain 66' (see FIG. 3) have been made. Consequently, the computer 84 does not determine whether a receptacle 38 is present; it similarly operates all of the servomotors 72-78 and Vac Motor 82 to operate the system, shown at 158. As shown at 160, when the operator presses the F1 key to operate the system in manual mode, the computer first determines whether the system has been aligned, shown at 162, and if so, the ram is cycled, shown at 164 and the servomotors 72, 74, 76 and Vac Motor 82 are actuated, and run according to predetermined, stored speed values, all shown at 166. This operation continues until the operator again presses the F1 key, at 168, to stop operation of the system.

Returning to FIG. 4A, if the operator elects to activate the system 60 operate in CLEAN-UP MODE, shown at 170, the computer 84 again actuates all of the servomotors and Vac Motor 82 except the servomotor 78 for the ram assembly 70. By not actuating the ram assembly 70, the life of the ram components is prolonged, since metal-to-metal contact is prevented.

As set forth in foregoing explanation, the invention provides for a high degree of flexibility in a product handling system which comprises a number of independently operating components, by coordinating the operation of each component by a computer, which is capable of varying the speed and sequencing of the servomotors which power each component. Consequently, it is possible to make adjustments for varying the overall operation of the system (e.g., packing groupings of five product items in an array as opposed to grouping four product items in an array, or varying the numbers of layers of groups in a particular recess of a receptacle) without making mechanical adjustments, other than replacing the index lug chain, which varies the spacing and size of the groups. Furthermore, it is also possible to fine tune the system by utilizing the computer capability of offsetting the alignment of the input conveyor and index lug chain conveyor relative to each other, simply by providing the appropriate input parameters to the computer.

As a result, not only is the time required to make adjustments in the system significantly reduced over prior art systems with mechanical interconnection of such components, the contamination often associated with handling mechanical components is eliminated.

While the forms of apparatus herein described constitute preferred embodiments of the invention, it is to be understood that the invention is not limited to these precise forms of apparatus, and that variations can be made therein without departing from the scope of the invention.

What is claimed is:

1. In a product filler head system having an input component for delivering product items individually; a product accumulating component for receiving product items from said input component and accumulating said items in groups of a selected number of items, then discharging said groups; a staging area including a product indexing component for receiving said groups of product items from said accumulating component and supporting said groups in an array; a product transfer component for displacing said array of groups of product items into a receptacle; and a computer control for individually actuating said input and accumulating components to sequence speed and timing of said input component and said product accumulating component to coordinate with said product indexing component and said product transfer component, a method of operating said system comprising:

actuating a first drive motor to drive said input component to deliver product items individually to said accumulating component;

actuating a second drive motor to drive said accumulating component to receive and accumulate said individual product items into a group of a selected number of items; and changing said selected number of items of said group by adjusting the speeds of said first and second drive motors.

2. The method of claim 1 further comprising the step of actuating a third drive motor to drive said indexing component and wherein said changing step includes a step of adjusting the speed of said third drive motor.

3. The method of claim 2 further comprising the step of actuating a fourth drive motor to drive said transfer component to actuate in sequence with said product indexing component and wherein said changing step includes a step of adjusting the speed of said fourth drive motor.

4. The method of claim 3 further comprising the step of programming a computer control to actuate said first, second, third and fourth drive motors and to adjust the speeds of said first, second, third and fourth drive motors.

5. The method of claim 2 wherein said indexing component includes an index lug chain and said changing step includes a step of replacing said index lug chain with a different index lug chain having appropriately spaced lugs.

6. A method for changing groupings of product items being loaded in receptacles by a product filler head system, the method comprising the steps of:

providing a product head filler system including an input component for delivering product items; a product accumulating component for receiving product items from said input component, accumulating said items in groups of a selected number of items and then discharging said groups; a staging area having a product indexing component for receiving said groups of product items from said accumulating component and supporting said groups in an array; and a product transfer component for displacing said array of groups of product items into a receptacle;

actuating a first drive motor to drive said input component to deliver product items individually to said accumulating component;

actuating a second drive motor to drive said accumulating component to receive and accumulate said individual product items into a group of a selected number of items; and changing speeds of said first and second drive motors to change said selected number of items of said group.

7. The method of claim 6 further comprising the steps of:

actuating a third drive motor to drive said indexing component; and changing a speed of said third drive motor to change said selected number of items of said group.

8. The method of claim 7 further comprising the steps of:

actuating a fourth drive motor to drive said transfer component to actuate in sequence with said product indexing component; and changing a speed of said fourth drive motor to change said selected number of items of said groups.

9. The method of claim 8 further comprising the step of:

programming a computer control to actuate said first, second, third and fourth drive motors and to change the speeds of said first, second, third and fourth drive motors.

10. The method of claim 8 wherein said indexing component includes an index lug chain and the method further comprises the step of replacing said index lug chain with a different index lug chain having appropriately spaced lugs.

11. A method for changing groupings of product items being loaded in receptacles by a product filler head system, the method comprising the steps of:

providing a product head filler system including an input component for delivering product items; a product accumulating component for receiving product items from said input component, accumulating said items in groups of a selected number of items and then discharging said groups; a staging area having a product indexing component for receiving said groups of product items from said accumulating component and supporting said groups in an array; and a product transfer component for displacing said array of groups of product items into a receptacle;

actuating a first drive motor to drive said input component to deliver product items individually to said accumulating component;

actuating a second drive motor to drive said accumulating component to receive and accumulate said individual product items into a group of a selected number of items;

actuating a third drive motor to drive said indexing component;

actuating a fourth drive motor to drive said transfer component to actuate in sequence with said product indexing component; and changing speeds of said first, second, third and fourth drive motors, by a central computer operatively coupled to the first, second, third and fourth drive motors, to change said selected number of items of said group.

* * * * *